US005181776A

United States Patent [19]

Tseng

[11] Patent Number: 5,181,776

[45] Date of Patent: Jan. 26, 1993

[54] LAMP SHADE

[76] Inventor: Everette Tseng, P.O. Box 82-144, Taipei, Taiwan

[21] Appl. No.: 780,294

[22] Filed: Oct. 22, 1991

[51] Int. Cl.[5] ..... F21V 1/00

[52] U.S. Cl. ..... 362/351; 362/352; 362/356; 362/360

[58] Field of Search ..... 362/351, 352, 353, 354, 362/355, 356, 360, 361

[56] References Cited

U.S. PATENT DOCUMENTS

| | | | |
|---|---|---|---|
| 559,149 | 4/1896 | Stenz | 362/361 |
| 1,363,782 | 12/1920 | Handel | 362/360 |
| 2,683,801 | 7/1954 | Faselt | 362/352 |
| 3,075,074 | 1/1963 | Asher | 362/352 |
| 4,165,529 | 8/1979 | Hagelthorn | 362/352 |
| 4,490,776 | 12/1984 | Kluch | 362/355 |
| 4,541,038 | 9/1985 | Van Noord | 362/351 |
| 4,605,999 | 8/1986 | Payne | 362/352 |
| 4,772,992 | 9/1988 | Tang | 362/352 |

FOREIGN PATENT DOCUMENTS

| | | | |
|---|---|---|---|
| 716111 | 10/1950 | Denmark | 362/352 |
| 1514017 | 1/1968 | France | 362/360 |
| 2445486 | 8/1980 | France | 362/353 |
| 633155 | 12/1949 | United Kingdom | 362/351 |
| 1400707 | 7/1975 | United Kingdom | 362/352 |

*Primary Examiner*—Richard R. Cole
*Attorney, Agent, or Firm*—Alfred Lee

[57] ABSTRACT

This invention relates to a lamp shade and in particular to one which includes a plurality of leaves each having a smooth flange around its circumference and a plurality of aligned protuberances along a center line of an inner side thereof, a rod fixedly mounted on a center line of the inner side of each leave, a retainer having a recess at one side and two grooves at the other, and a fixing support having a plurality of teeth each engaged with the groove of the retainer, whereby the lamp shade is easily assembled when in use and easily dismantled for stowage and transportation.

1 Claim, 4 Drawing Sheets

LAMP SHADE

BACKGROUND OF THE INVENTION

It is found that the prior art lamp shade is fixed in construction and cannot be dismantled when not in use. Hence, it will be inconvenient to stow the lamp shade when not in use and it will also occupy a large space when in transportation thereby increasing the transportation cost.

Therefore, it is an object of the present invention to provide a lamp shade which may obviate and mitigate the above-mentioned drawbacks.

SUMMARY OF THE INVENTION

This invention relates to an improved lamp shade.

It is the primary object of the present invention to provide a lamp shade which may be dismantled when not in use.

It is another object of the present invention to provide a lamp shade which is easy to be stowed.

It is still another object of the present invention to provide a lamp shade which is facile for transportation.

It is still another object of the present invention to provide a lamp shade which is economic to produce.

It is a further object of the present invention to provide a lamp shade which is inexpensive to manufacture.

Other objects and merits and a fuller understanding of the present invention will be obtained by those having ordinary skill in the art when the following detailed description of the preferred embodiment of the present invention is read in conjunction with the accompanying drawings.

DETAILED DESCRIPTION OF THE PREFERRED EMBODIMENT

Figure 1:
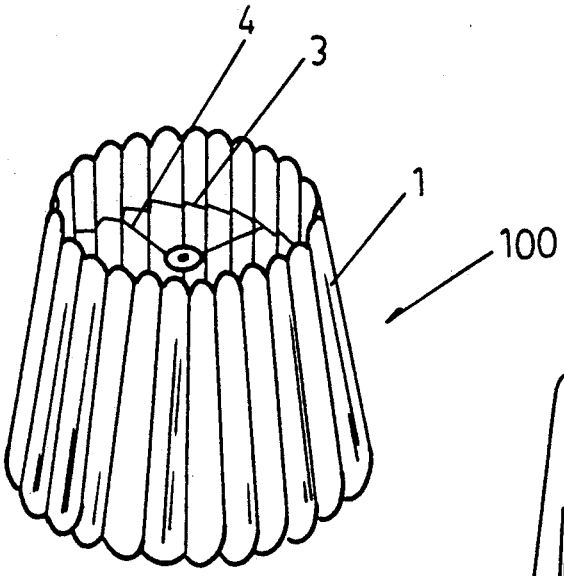
FIG. 1 is a perspective view of a lamp shade according to the present invention.
Figure 2:
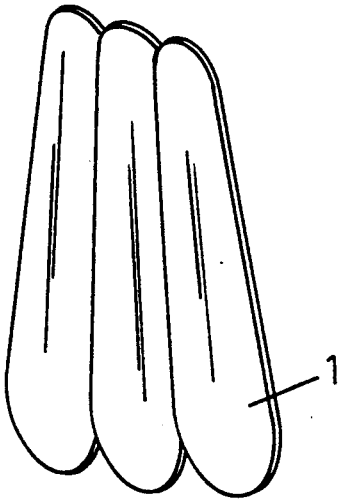
FIG. 2 is an enlarged fragmentary view of the FIG. 1.
Figure 4:
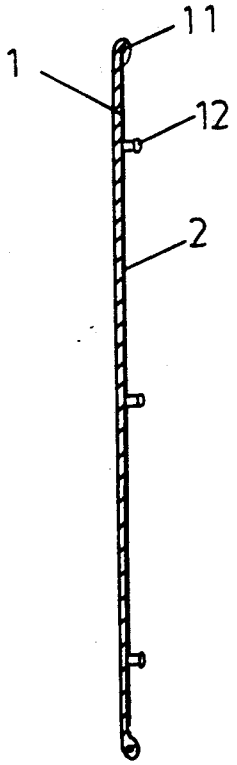
FIG. 4 is a side view of FIG. 3.
Figure 3:
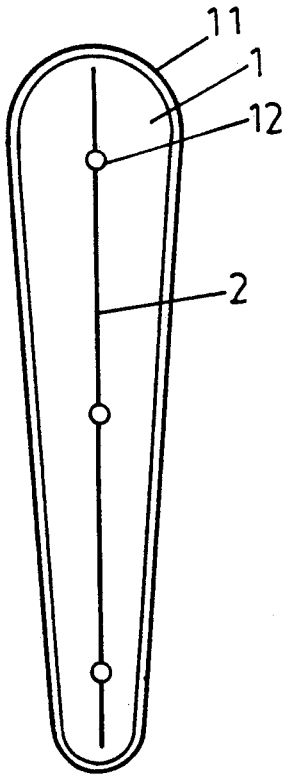
FIG. 3 is a front view of a leaf according to the present invention.
Figure 6:
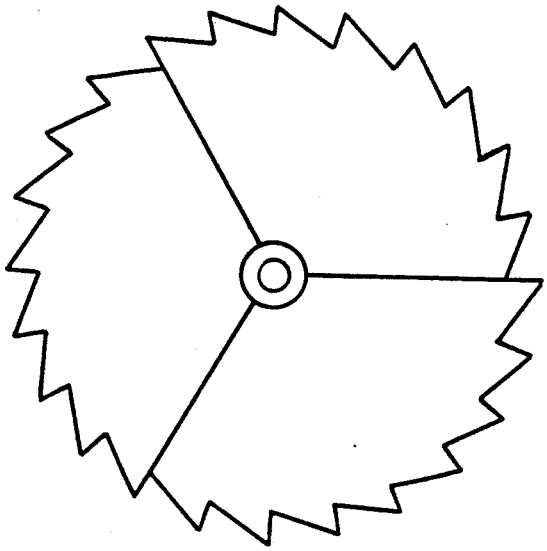
FIG. 6 is a top view of the present invention with a connector.
Figure 5:
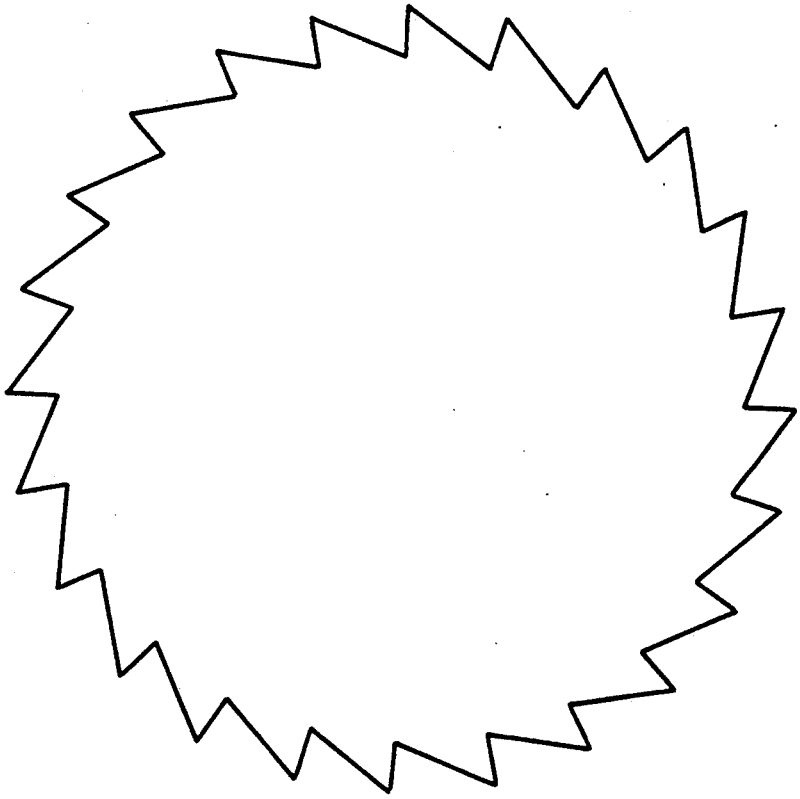
FIG. 5 is a top view of the present invention.
Figure 8:
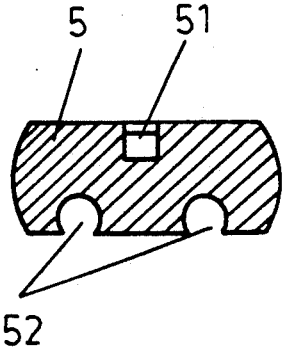
FIG. 8 is a sectional top view of the retainer for the leaf.
Figure 7:
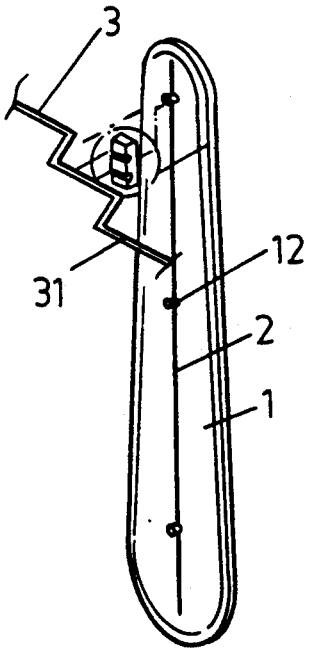
FIG. 7 shows the way to fix the leaf in postion.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings, the lamp shade 100 according to present invention mainly comprises a plurality of leaves 1, a rod, 2 fixedly mounted on the center line of the each leaf 1, by any appropriate known means a plurality of fixing supports 3, a light bulb holder 4 and a plurality of retainers 5.

The leaf 1 has a smooth flange 11 around its circumference so as to prevent one's hand from being hurted and three aligned protuberances 12 along the center line of its inner side. The rod 2 is fixedly mounted on the center line of the inner side of the leaf 1.

The leaf 1 is engaged with the fixing support 3 by the retainer 5. The retainer 5 is preferably made of plastic and has a recess 51 at one side and two grooves 52 at the other.

In assembly, the leaf 1 is first engaged with the fixing support 3 simply by press-fitting the retainer 5 with a protuberance 12 fixedly mounted on the inner side of the leaf 1 so that the recess 51 of the retainer 5 is engaged with the protuberance 12 and then the retainer 5 is press-fitted with a tooth of the fixing support 3 so that the groove 52 is engaged with the tooth 31 of the fixing support 3, thereby fixedly connecting the leaf 1 with the fixing support 3. After ail leaves 1 are engaged with the fixing support 3, the light bulb holder 4 is mounted on the fixing support 3 for reinforcing the structure and a lamp shade will be completely assembled.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A lamp shade comprising:

a plurality of leaves each having a smooth flange around a circumference and a plurality of aligned protuberances along a center line of an inner side thereof;

a rod fixedly mounted on a center line of the inner side of each said leaf;

a retainer having a recess at one side thereof and two grooves at the other side thereof, the recess of said retainer being engageable with one of said protuberances; and a fixing support having a plurality of teeth each engaged with one of the grooves of said retainer.

* * * * *